US010586527B2

(12) United States Patent
Dexter et al.

(10) Patent No.: US 10,586,527 B2
(45) Date of Patent: Mar. 10, 2020

(54) TEXT-TO-SPEECH PROCESS CAPABLE OF INTERSPERSING RECORDED WORDS AND PHRASES

(71) Applicant: Cepstral, LLC, Pittsburgh, PA (US)

(72) Inventors: Patrick Dexter, Pittsburgh, PA (US); Kevin Jeffries, Allentown, PA (US)

(73) Assignee: Third Pillar, LLC, Pittsburgh, PA (US)

( * ) Notice: Subject to any disclaimer, the term of this patent is extended or adjusted under 35 U.S.C. 154(b) by 74 days.

(21) Appl. No.: 15/792,861

(22) Filed: Oct. 25, 2017

(65) Prior Publication Data

US 2018/0114523 A1 Apr. 26, 2018

Related U.S. Application Data

(60) Provisional application No. 62/412,336, filed on Oct. 25, 2016.

(51) Int. Cl.
*G10L 13/02* (2013.01)
*G10L 13/08* (2013.01)

(52) U.S. Cl.
CPC ..... *G10L 13/08* (2013.01); *G10L 13/086* (2013.01)

(58) Field of Classification Search
CPC ..... G10L 13/02; G10L 13/00; G10L 13/027; G10L 13/047; G10L 13/06; G10L 13/08; G10L 13/086
USPC ..... 704/258, 260, 263, 266, 270, 278
See application file for complete search history.

(56) References Cited

U.S. PATENT DOCUMENTS

| | | | | |
|---|---|---|---|---|
| 8,290,775 | B2 | 10/2012 | Etezadi et al. | |
| 9,483,461 | B2 | 11/2016 | Fleizach et al. | |
| 2005/0182630 | A1* | 8/2005 | Miro | G10L 13/08 704/269 |
| 2007/0118377 | A1* | 5/2007 | Badino | G10L 13/08 704/260 |
| 2011/0246172 | A1 | 10/2011 | Liberman et al. | |
| 2013/0132069 | A1* | 5/2013 | Wouters | G06F 17/28 704/8 |
| 2015/0228271 | A1* | 8/2015 | Morita | G10L 13/033 704/258 |
| 2016/0012035 | A1* | 1/2016 | Tachibana | G10L 13/00 704/10 |
| 2017/0221471 | A1 | 8/2017 | Sharifi et al. | |

* cited by examiner

*Primary Examiner* — Qi Han
(74) *Attorney, Agent, or Firm* — McKay & Associates, P.C.

(57) ABSTRACT

Creating and deploying a voice from text-to-speech, with such voice being a new language derived from the original phoneset of a known language, and thus being audio of the new language outputted using a single TTS synthesizer. An end product message is determined in an original language n to be outputted as audio n by a text-to-speech engine, wherein the original language n includes an existing phoneset n including one or more phonemes n. Words and phrases of a new language n+1 are recorded, thereby forming audio file n+1. This new audio file is labeled into unique units, thereby defining one or more phonemes n+1. The new phonemes of the new language are added to the phoneset, thereby forming new phoneset n+1, as a result outputting the end product message as an audio n+1 language different from the original language n.

14 Claims, 3 Drawing Sheets

```
;;; PHONES BEGIN
   (pau -   0   0   0   0   0   0   0   0    -)  ; silence ...

;;;;;;;;;;;;;;;;;;
;;; CONSONANTS ;;;
;;;;;;;;;;;;;;;;;;

;  stop consonants
;  name v/c **  **  *** *** ** ** **  ** ***
   (bh  -   0   0   0   0   0   0   0   0    -)  ; EN
   (bi  -   0   0   0   0   0   0   0   0    -)  ; EN
   (bj  -   0   0   0   0   0   0   0   0    -)  ; EN
   (bk  -   0   0   0   0   0   0   0   0    -)  ; EN
   (bl  -   0   0   0   0   0   0   0   0    -)  ; EN
```

Figure 3

```
[pdexter@localhost Dallas]$ more lexicon.txt
som1001 0 bh
som1002 0 bj
som1003 0 bk
som1004 0 ff
som1005 0 bm
som1006 0 bn
```

Figure 4

TEXT-TO-SPEECH PROCESS CAPABLE OF INTERSPERSING RECORDED WORDS AND PHRASES

CROSS-REFERENCE TO RELATED APPLICATIONS

The present application claims benefit of provisional application Ser. No. 62/412,336 filed Oct. 25, 2016, the contents of which are incorporated herein by reference.

BACKGROUND

Field of the Invention

The instant invention relates to voice building using text-to-speech (TTS) processes. Particularly, the process and product described is a text to speech voice built after interspersing recorded words and phrases from one language with audio from another language, thereby providing the capability of pronouncing items that a listener understands in one language with phrases that are more easily understood in a different language useful, for example, for emergency messaging services.

Description of the Related Art

A speech synthesizer may be described as three primary components: an engine, a language component, and a voice database. The engine is what runs the synthesis pipeline using the language resource to convert text into an internal specification that may be rendered using the voice database. The language component contains information about how to turn text into parts of speech and the base units of speech (phonemes), what script encodings are acceptable, how to process symbols, and how to structure the delivery of speech. The engine uses the phonemic output from the language component to optimize which audio units (from the voice database), representing the range of phonemes, best work for this text. The units are then retrieved from the voice database and combined to create the audio of speech.

Most deployments of text-to-speech occur in a single computer or in a cluster. In these deployments the text and text-to-speech system reside on the same system. On major telephony systems the text-to-speech system may reside on a separate system from the text, but all within the same local area network (LAN) and in fact are tightly coupled. The difference between how a consumer and telephony system function is that for the consumer, the resulting audio is listened to on the system that did the synthesis. On a telephony system, the audio is distributed over an outside network (either wide area network or telephone system) to the listener.

As is known, Emergency Alert Systems (EAS) are local or national warning systems designed to alert the public. Broadcasts are audibly distributed over wireline television and radio services and digital providers. Wireless emergency alert systems are also in place in some jurisdictions designed and targeted at smartphones. Therefore, broadcasting systems can function in conjunction with national alert systems or independently while still broadcasting identical information to a wide group of targets.

The majority of targets of broadcasts in the United States would understand the major world languages. Approximately half of the world's population speak English, Spanish, Russian French and Hindustani. However, there are thousands of different languages and pockets of populations within the United States and other countries that do not understand the major languages. For example, there are ethnic groups in and around St. Paul, Minn. who only speak and understand Hmong and Somali. Accordingly, in the event of a wide or local emergency broadcast, or any message meant to be relayed quickly, it would be impossible to effectively communicate to these groups.

The instant product and process allows for the building and deployment of a niche voice "overload" of a major language after interspersing recorded words and phrases from one language with audio from another language, using one TTS synthesizer. As such, provided is the capability of substituting items that a listener understands in one language with phrases that are more easily understood in a different language, useful, for example, for emergency messaging services.

SUMMARY

As is known, a TTS engine accesses a lexicon or library of phonemes or phonemic spellings stored in the storage of the system. Once a message is generated from a given portion of text, the audible message is played via the output device of the system such as a speaker or headset. In the prior art, to "speak" a different language, a second or more TTS engines are employed because they must access a separate lexicon or word database built with the second language. Such a process is inefficient, especially when the desired output might be a standard, short audio file. Herein described, therefore, is a methodology for producing a different language output using largely the original lexicon. The TTS engine accesses a lexicon or library of phonemes stored in the storage of the system. Once a message is generated from a given portion of text, the audible message is played via the output device of the system such as a speaker or headset. The above and other problems are solved by providing the instant method, performed using a computer, for deploying a voice from text-to-speech, with such voice being a new language derived from the original phoneset of a known language, and thus being audio of the new language outputted using a single TTS synthesizer.

Accordingly, the method comprehends, determining an end product message in an original language n to be outputted as audio n by a text-to-speech engine, wherein the original language n includes an existing phoneset n including one or more phonemes n; recording words and phrases of a language n+1, thereby forming audio file n+1; labeling the audio file n+1 into unique phrases, thereby defining one or more phonemes n+1; adding the phonemes n+1 to the existing phoneset n, thereby forming new phoneset n+1, as a result outputting the end product message as an audio n+1 language different from the original language n.

BRIEF DESCRIPTION THE DRAWINGS

FIG. 3 shows an example phoneset.

FIG. 4 shows an example screenshot of a new lexicon file created by code word assignment.

DETAILED DESCRIPTION OF THE PREFERRED EMBODIMENT

Figure 1:
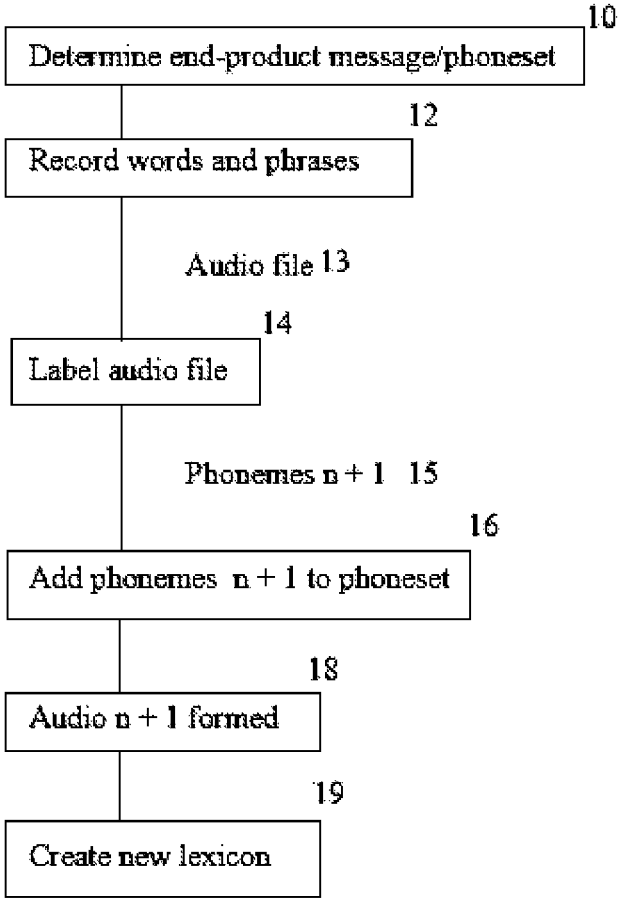
FIG. 1 shows a flow chart of the overall process.

The description, flow charts, diagrammatic illustrations and/or sections thereof represent the method with computer control logic or program flow that can be executed by a specialized device or a computer and/or implemented on computer readable media or the like (residing on a drive or device after download) tangibly embodying the program of instructions. The executions are typically performed on a computer or specialized device as part of a global communications network such as the Internet. For example, a computer or mobile phone typically has a web browser or user interface installed within the CPU for allowing the viewing of information retrieved via a network on the display device. A network may also be construed as a local, ethernet connection or a global digital/broadband or wireless network or cloud computing network or the like. The specialized device, or "device" as termed herein, may include any device having circuitry or be a hand-held device, including but not limited to a tablet, smart phone, cellular phone or personal digital assistant (PDA) including but not limited to a mobile smartphone running a mobile software application (App). Accordingly, multiple modes of implementation are possible and "system" or "computer" or "computer program product" or "non-transitory computer readable medium" covers these multiple modes. In addition, "a" as used in the claims means one or more.

In this embodiment system is also meant to include, but not be limited to, a processor, a memory, display and input device such as a keypad or keyboard. One or more applications are loaded into memory and run on or outside the operating system. One such application, critical here, is the text-to-speech (TTS) engine. The TTS engine is meant to define the software application operative to receive text-based information and to generate audio, or an audible message, derived from the received information. As is known in the art, the TTS engine accesses a lexicon or library of phonemes stored in the storage of the system. Once a message is generated from a given portion of text, the audible message is played via the output device of the system such as a speaker or headset. In the prior art, to "speak" a different language, a second or more TTS engines are employed because they must access a separate lexicon or word database built with the second language. Such a process is inefficient, especially when the desired output might be a standard, short audio file. Herein described, therefore, is a methodology for producing a different language output using the original lexicon.

Referencing then FIGS. 1-4, the original end-product message is determined 10. The original end-product message is the message to be delivered, e.g. broadcasted, in an original language n. Original language n would typically be a primary widely used language such as English, "n" representing the original build. An example end product message in original language n being English would be "The National Weather Service has issued a severe thunderstorm warning" and/or "The National Weather Service has issued a tornado watch". The example used herein is an emergency broadcast message but the method and system is not limited to this particular need. The end-product message is simply identified from customer requirements or general need in the marketplace. For the above as it relates to an original language, the instant process may not be needed to build the message in a primary language since standard TTS builds can be used to access the already known Lexicon of English words, i.e. "thunderstorm" or "tornado". Nonetheless, the end-product message must still be determined for the particular customer need.

Once determined, a new language is identified 11 based on customer requirements or general need in the marketplace. Termed herein "language n+1", language n+1 would be the same understood message, but in another, typically rare language. For example, a small pocket of Somali exists in the U.S. state of Minnesota. A message broadcast in original language n (English) might not be understood by all individuals, and it would be unlikely that a Lexicon exist for a language that is not a major world language, and a build-out therefore would be inefficient, thus the applicability of the instant method. So the words and phrases for language n+1 must be determined. For example, how would a Somalian-speaking individual understand the subject alert message? The specific phrases can be determined in a number of ways including customer requirements or analysis of bulk input text.

The relevant words and phrases of language n+1 are recorded 12. The words and phrases can be recorded by a microphone connected to a computer or other recording device. As a result, an audio file 13 for language n+1 is produced.

The audio file 13 for language n+1 is then labeled 14. The process of "labeling" generally means the words and phrases are analyzed for unique audio and separated into unique audio files. This means the phrases are separated either manually or by an automated process using publicly available software, "unique" meaning whether each word or phrase is different from another. In the example above, there are three (3) unique audio files, tabulated below in table 1:

TABLE 1

| |
|---|
| 1. The National Weather Service has issued |
| 2. a severe thunderstorm warning |
| 3. a tornado watch |

In a concatenative TTS voice a large database of recorded audio is labeled into short fragments called units. Each unit is labelled and assigned to a phoneme in the phoneset. "Labelling" means the audio is tagged with metadata to provide information like length of audio file, fundamental frequency and pitch. This can be done manually or as an automated process with publicly available software. The instant approach combines this existing practice with audio from one or more languages different than Language n. The recorded audio from Language n+1 is labelled and each audio recording is assigned to one unique new phoneme in Phoneset n+1. The audio can be labeled as sounds, short fragments of words, words, phrases, or sentences. A typical Unit Selection Concatenative Speech Synthesis voice will have one or more (and likely tens of thousands) of labeled audio recordings assigned to a single phoneme. In the instant approach a new phoneme in Phoneset n+1 will by design only have one labeled audio recording assigned to it. This process is repeated for each language 3, 4, n added to Phoneset n.

Herein, it must be determined what individual words and phrases are needed in the end-product and must be recorded as unique audio files. So analysis of the existing phoneset for a text to speech voice in a given language (Language n) is done to determine the identities of all phonemes that make up the phoneset (Phoneset n). In this context we are looking for phonemes that do not exist in this phoneset so that they can be added for the new use 16. A phoneme is a perceptually distinct unit of sound in a specified language. The phoneset is the list of phonemes that are defined and available within a text to speech voice. FIG. 3 shows an example phoneset. Novel and unique phonemes, beyond the scope of the original language n, are created and added to Phoneset n for Language n to create an overloaded Phoneset n or Phoneset n+1, termed now n+1. The number of new phonemes that need to be added to Phoneset 1 is equal to the number of unique audio files that will be added to the voice. The unique audio files are words or phrases in one or more languages different from Language 1 that are defined in step 1.

Figure 2:
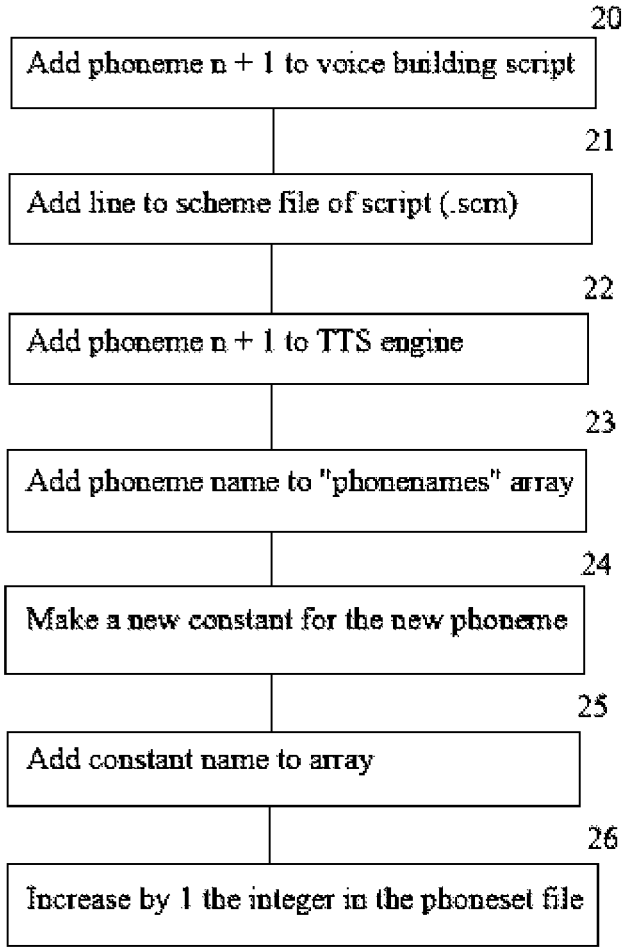
FIG. 2 shows a more detailed flow chart of the step of adding a phoneme.

FIG. 2 shows the steps involved in the process of adding a phoneme to the phoneset 16. Generally, the compilation instructions directly within the TTS open source code is changed, i.e. update; build scripts, makefiles, and other compilation instructions necessary to build the TTS software with the updated phonemes and phonesets, where required. More particularly, first the voice building script is modified. This is done by adding a line to the script, for instance adding line to the scheme file (.scm) 21. The scheme file is identifiable within open source, but the type of file and programming language might vary depending on the source. Next, the TTS engine itself has to be modified. Phoneme n+1 is added to the TTS engine 22 by adding the phoneme name to the "phonemes" array 23. A new constant is then made for the new phoneme 24. The constant name is added to the array 25. Then, the integer in the phone set file is increased by one (1) 26. As a result, phoneme n+1 is added to the existing phoneset n such that audio file n+1 can now be formed and outputted 18 (revert to FIG. 1).

The new lexicon can now be created 19. Unique text entries or code words are added to the user lexicon file or added to the lexical analyzer built into the engine. The user lexicon can be a text file or word processing document and new entries are typed and saved. The code word can be an acronym or other unique combination of letters. Each phoneme from Phoneset 1*a* is assigned to a code word on a 1:1 basis. Thus, for a given text that contains one or more code words, they are identified, and the correct phoneme from Phoneset n+1 is assigned and interpreted by the text to speech engine. FIG. 4 shows an example lexicon with code words assigned on a 1:1 basis, using phoneset of FIG. 3.

The process and processes described results in a text to speech voice capable of interspersing recorded words and phrases from n Language(s) with audio from Language 1, or language n. Among other practical uses this provides a means to pronounce place names, dates, and times that a listener understands in one language with phrases and warning that are more easily understood in a different language, without using two separate TTS engines.

We claim:

1. A method performed using a computer for deploying a voice from text-to-speech, comprising the steps of:

determining an end product message in an original language n to be outputted as audio n by a text-to-speech engine, wherein said original language n includes an existing phoneset n including one or more phonemes n of a known Lexicon;

recording words and phrases of a language n+1, thereby forming an audio file n+1;

labeling said audio file n+1 into unique phrases, thereby defining one or more phonemes n+1, wherein said phonemes n+1 do not exist in any other language; and, adding said phonemes n+1 to said existing phoneset n, wherein for the step of adding said phonemes n+1, a voice building script is modified by changing a scheme file within open source code, thereby overloading said known Lexicon and forming new phoneset n+1, as a result outputting said end product message as a language different from said original language n while still using said known Lexicon.

2. The method of claim 1, further comprising the step of creating a new lexicon file.

3. The method of claim 2, wherein one or more code words are added to said new lexicon file.

4. The method of claim 3, wherein each said code word is assigned to each said phonemes n+1 on a 1:1 basis.

5. The method of claim 1, further comprising modifying said text-to-speech engine by changing a phonemes array within said open source code.

6. A system for deploying a voice from text-to-speech, comprising:

a computer including a text-to-speech engine;

a non-transitory computer-readable medium coupled to said computer having instructions stored thereon which upon execution causes said computer to:

receive an end product message in an original language n to be outputted as audio n by said text-to-speech engine, wherein said original language n includes an existing phoneset n including one or more phonemes n of a known Lexicon;

record words and phrases of a language n+1, thereby forming an audio file n+1;

label said audio file n+1 into unique phrases, thereby defining one or more phonemes n+1, wherein said phonemes n+1 do not exist in any other language;

add said phonemes n+1 to said existing phoneset n, thereby forming new phoneset n+1;

a modified voice building script including a changed scheme file within an open source code;

as a result, said end product message outputted as an audio n+1 language different from said original language n while still using said known Lexicon.

7. The system of claim 6, further comprising a new lexicon file created by adding one or more code words thereto.

8. The system of claim 7, wherein each said code word is assigned to each said phonemes n+1 on a 1:1 basis.

9. The system of claim 6, further comprising a modified text-to-speech engine including a changed phoneme array within said open source code.

10. A method performed using a computer for deploying a voice from text-to-speech, comprising the steps of:

determining an end product message in an original language n to be outputted as audio n by a text-to-speech engine, wherein said original language n includes an existing phoneset n including one or more phonemes n;

recording words and phrases of a language n+1, thereby forming an audio file n+1;

labeling said audio file n+1 into unique phrases, thereby defining one or more phonemes n+1; and, modifying a voice building script by changing a scheme file within open source code to add said phonemes n+1 to said existing phoneset n, thereby forming new phoneset n+1, as a result outputting said end product message as an audio n+1 language different from said original language n.

11. The method of claim 10, further comprising modifying said text-to-speech engine by changing a phonemes array within said open source code.

12. The method of claim 10, further comprising the step of creating a new lexicon file.

13. The method of claim 12, wherein one or more code words are added to said new lexicon file.

14. The method of claim 13, wherein each said code word is assigned to each said phonemes n+1 on a 1:1 basis.

* * * * *